US011131239B2

(12) United States Patent
Kishimoto et al.

(10) Patent No.: US 11,131,239 B2
(45) Date of Patent: Sep. 28, 2021

(54) SHIP PROPULSION DEVICE

(71) Applicant: SUZUKI MOTOR CORPORATION, Hamamatsu (JP)

(72) Inventors: Morio Kishimoto, Hamamatsu (JP); Chiaki Suzuki, Hamamatsu (JP); Jun Ito, Hamamatsu (JP)

(73) Assignee: SUZUKI MOTOR CORPORATION, Shizuoka (JP)

( * ) Notice: Subject to any disclaimer, the term of this patent is extended or adjusted under 35 U.S.C. 154(b) by 0 days.

(21) Appl. No.: 16/897,253

(22) Filed: Jun. 9, 2020

(65) Prior Publication Data

US 2020/0392894 A1 Dec. 17, 2020

(30) Foreign Application Priority Data

Jun. 13, 2019 (JP) ..... JP2019-110092

(51) Int. Cl.
*B63H 20/24* (2006.01)
*F02B 61/04* (2006.01)
*F01N 13/00* (2010.01)

(52) U.S. Cl.
CPC ..... *F02B 61/045* (2013.01); *F01N 13/004* (2013.01); *F01N 2590/021* (2013.01)

(58) Field of Classification Search
CPC . F01N 13/004; F01N 2590/021; F02B 61/045
See application file for complete search history.

(56) References Cited

U.S. PATENT DOCUMENTS 6,632,110 B2 * 10/2003 Kato ..... F01N 3/2046 440/89 H
6,884,133 B2 * 4/2005 Ishii ..... F01N 13/008 440/89 H
8,814,619 B2 8/2014 Maekawa et al.
9,869,228 B2 * 1/2018 Achiwa ..... F01N 13/10
10,876,459 B1 * 12/2020 Wasil ..... F01N 9/00
2013/0029545 A1 1/2013 Maekawa et al.

FOREIGN PATENT DOCUMENTS

JP 2012159062 A 8/2012

* cited by examiner

*Primary Examiner* — Andrew Polay
(74) *Attorney, Agent, or Firm* — Holtz, Holtz & Volek PC

(57) ABSTRACT

First to fourth exhaust passages are provided in a raw blank of a cylinder block, which can be used for both a first exhaust route and a second exhaust route, one of which is selected for use as an exhaust passage. In the first exhaust route, a fifth exhaust passage couples between opening ends of the first and second exhaust passages and is formed in a separate member from the cylinder block, exhaust gas is allowed to flow via the fourth, first, fifth, second, and third exhaust passages, and a catalyst is placed in the exhaust passages. In the second exhaust route, a communication hole is provided in a partition wall between the fourth exhaust passage and the second exhaust passage while the opening ends of the first and second exhaust passages are closed, and the exhaust gas is allowed to flow via the fourth, second, and third exhaust passages.

6 Claims, 10 Drawing Sheets

SHIP PROPULSION DEVICE

BACKGROUND OF THE INVENTION

Field of the Invention

The present invention relates to a ship propulsion device.

Description of the Related Art

A conventional ship propulsion device (outboard motor) is known that enables utilization of an engine for both of a catalyst-equipped model and a non-catalyst-equipped model depending on the usage environment (e.g., Japanese Patent Laid-Open No. 2012-159062). This patent literature discloses a ship propulsion device in which a body tube portion of an exhaust manifold is integrated into a cylinder head constituting an engine unit, while a catalyst unit of the exhaust manifold is separated from the cylinder head and a cylinder block, to support both of the catalyst-equipped model and the non-catalyst-equipped model in accordance with whether the catalyst unit is mounted.

However, in the ship propulsion device described in the above patent literature, due to the integral formation of the body tube portion of the exhaust manifold into the cylinder head, the upper limit on the size (capacity/volume) of the mountable catalyst is restricted, while the manufacturing of the cylinder head becomes complex, and a situation may occur in which exhaust-gas purifying performance cannot be ensured efficiently. In recent years, there has been required a ship propulsion device capable of ensuring sufficient exhaust-gas purifying performance without the need for a complex manufacturing process, and achieving an engine for a catalyst-equipped model and a non-catalyst-equipped model without the need for a large-scale change.

SUMMARY OF THE INVENTION

An object of the present invention is to provide a ship propulsion device capable of ensuring sufficient exhaust-gas purifying performance without the need for a complex manufacturing process, and achieving an engine for a catalyst-equipped model and a non-catalyst-equipped model without the need for a large-scale change.

One aspect of a ship propulsion device of the present invention is a ship propulsion device including: a manifold formed on sides of a plurality of cylinders in a cylinder block; and an exhaust passage that allows exhaust gas to flow from the manifold toward a lower part of the cylinder block. The following exhaust passages are formed in a raw blank of the cylinder block: a first exhaust passage extending in an arrangement direction of the plurality of cylinders and having an opening end; a second exhaust passage extending in a longitudinal direction of the plurality of cylinders and having an opening end; a third exhaust passage connected to the second exhaust passage and extending to a side opposite to the first exhaust passage across the second exhaust passage; and a fourth exhaust passage extending in a direction orthogonal to the first exhaust passage and the second exhaust passage between the first exhaust passage and the second exhaust passage, and connecting the first exhaust passage and the manifold. The raw blank of the cylinder block can be used for both of two exhaust routes (a) and (b):

(a) a first exhaust route in which a fifth exhaust passage coupling the opening end of the first exhaust passage and the opening end of the second exhaust passage is formed in a separate member from the cylinder block, the exhaust gas is allowed to flow via the fourth exhaust passage, the first exhaust passage, the fifth exhaust passage, the second exhaust passage, and the third exhaust passage, and a catalyst is placed in the exhaust passage; and (b) a second exhaust route in which a communication hole is provided in a partition wall provided between the fourth exhaust passage and the second exhaust passage while the opening ends of the first and second exhaust passages are closed, and the exhaust gas is allowed to flow via the fourth exhaust passage, the second exhaust passage, and the third exhaust passage, and one of the first exhaust route and the second exhaust route is selected to be used as the exhaust passage.

According to the present invention, it is possible to ensure sufficient exhaust-gas purifying performance without the need for a complex manufacturing process, and achieve an engine for a catalyst-equipped model and a non-catalyst-equipped model without the need for a large-scale change.

BRIEF DESCRIPTION OF THE DRAWINGS

A number of new points representing the features of the present invention are detailed in the claims attached to this specification. For fully understanding the present invention, the operational benefits thereof, and an object achieved by the implementation thereof, the accompanying drawings and articles explaining a preferred embodiment of the present invention by illustration are to be referred to.

DETAILED DESCRIPTION OF THE PREFERRED EMBODIMENT

Figure 1:
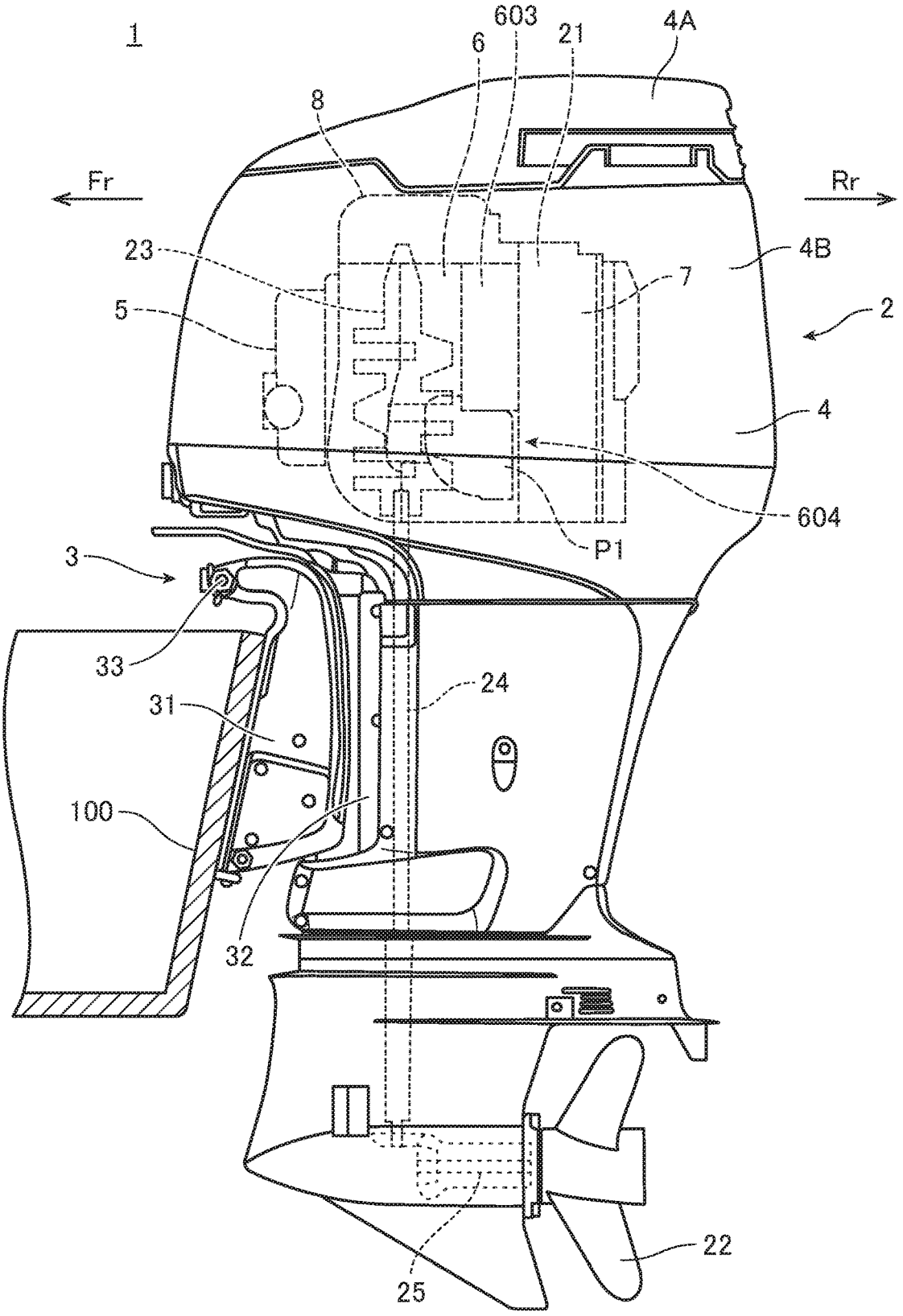
FIG. 1 is a left side view illustrating a schematic configuration of an outboard motor as a ship propulsion device according to the present embodiment.
Figure 2:
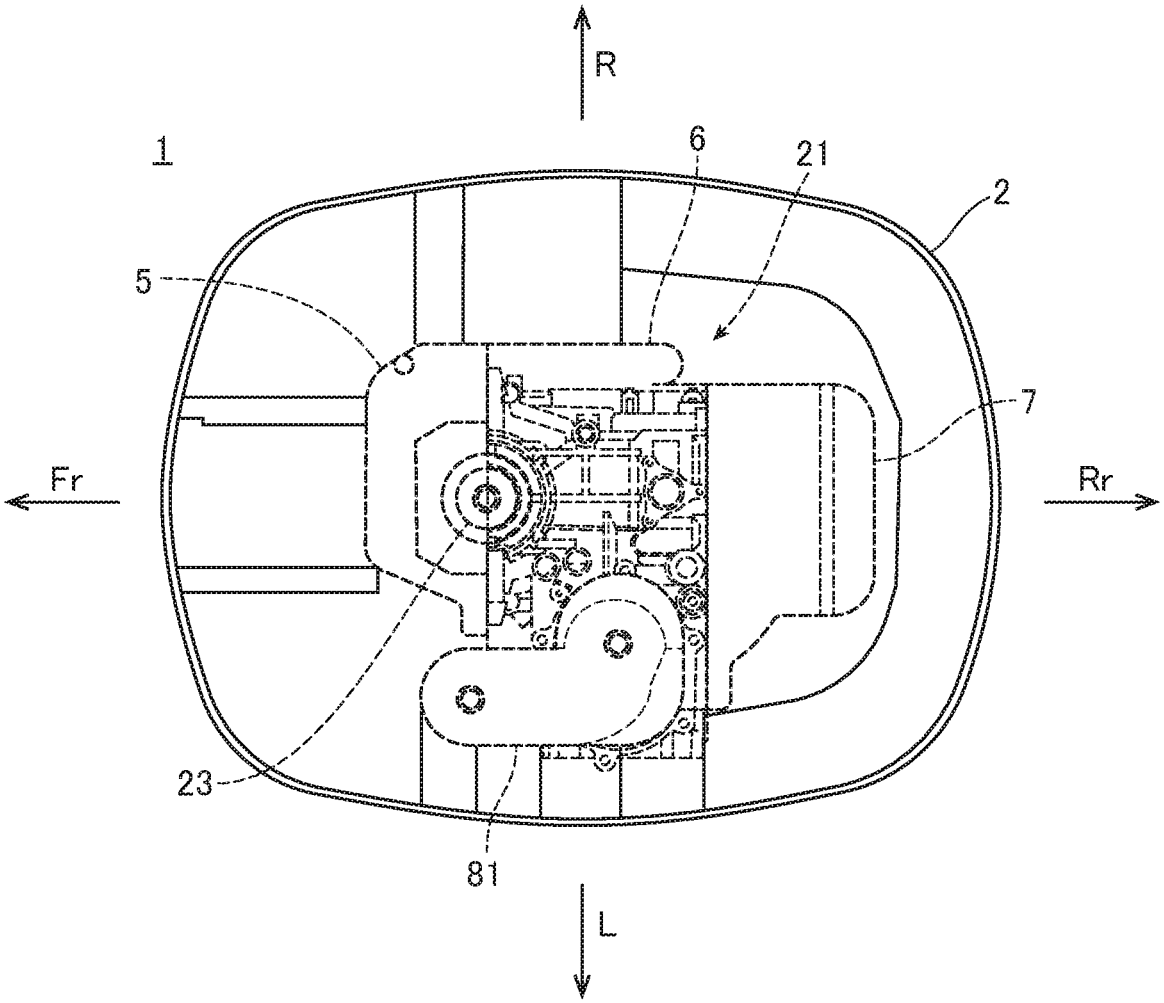
FIG. 2 is a top view illustrating the schematic configuration of the outboard motor according to the present embodiment.

An embodiment of the present invention will be described below in detail with reference to the accompanying drawings. The following description will be made using an outboard motor as an example of a ship propulsion device according to the present invention. FIG. 1 is a left side view illustrating a schematic configuration of an outboard motor 1 as a ship propulsion device according to the present embodiment. FIG. 2 is a top view illustrating the schematic configuration of the outboard motor 1 according to the present embodiment. In the following, for convenience of description, arrow Fr indicates the front of the outboard motor 1, arrow Rr indicates the rear of the outboard motor 1, arrow L indicates the left side of the outboard motor 1, and arrow R indicates the right side of the outboard motor 1.

As illustrated in FIG. 1, the outboard motor 1 includes: an outboard motor body 2 in which a driving force generated by a mounted engine 21 is transmitted to a propeller 22 to generate a propulsion force; and an attachment bracket device 3 for attaching the outboard motor body 2 to a stern (transom) 100 of a hull.

The outboard motor body 2 has the engine 21 mounted in the upper portion and is able to drive the propeller 22 in the lower portion. As the engine 21, for example, a multi-cylinder engine such as a parallel four-cylinder engine can be employed. The entire outboard motor body 2 is covered with an exterior cover. In particular, the engine 21 is covered with an engine cover 4 that is an exterior. The engine cover 4 is configured by integral coupling of an engine cover 4A constituting an upper cover that covers the upper circumference of the engine 21 and an engine cover 4B constituting a lower cover. With such an engine cover 4, an engine room that houses the engine 21 has a sealed structure and is blocked from the outside air.

The attachment bracket device 3 includes a clamp bracket 31 and a swivel bracket 32. The clamp bracket 31 is provided detachably at the stern 100 of the hull. The swivel bracket 32 supports the outboard motor body 2 in a horizontally swingable manner and supports the outboard motor body 2 in a perpendicularly swingable manner with respect to the clamp bracket 31 via a swivel shaft 33. With this configuration, the outboard motor body 2 is attached to the hull while being swingable in each of the horizontal direction (steering direction) and the perpendicular direction (tilt direction).

In the engine room, the engine 21 is mounted vertically so that crankshaft 23 faces the perpendicular direction. The crankshaft 23 is coupled with a drive shaft 24. The propeller 22 is attached to one end (rear end) of a propeller shaft 25. With this configuration, the rotational force of the engine 21 is transmitted to the propeller shaft 25 via the drive shaft 24, and the propeller 22 rotates forwardly or reversely. This gives the hull a propulsion force on the forward or reverse side.

At the foremost (bow) of the engine 21, a crankcase 5 is disposed. A cylinder block 6 is disposed behind the crankcase 5, and a cylinder head 7 is disposed behind the cylinder block 6 (cf. FIG. 2). The crankshaft 23 is disposed such that its shaft center is located between the crankcase 5 and the cylinder block 6 (more specifically, on the mating surface of the crankcase 5 and the cylinder block 6).

The outboard motor 1 according to the present embodiment is configured to enable the utilization of the engine 21 for a catalyst-equipped model and a non-catalyst-equipped model depending on the usage environment without the need for a large-scale change. In order to utilize the engine 21 for the catalyst-equipped model and the non-catalyst-equipped model without making a large-scale change on the engine 21 as thus described, selectively usable exhaust passages are formed in the cylinder block 6, and an exhaust passage to be used is selected in accordance with whether the catalyst is equipped. The configuration of the engine 21 will be described below with a focus on the cylinder block 6.

Figure 3:
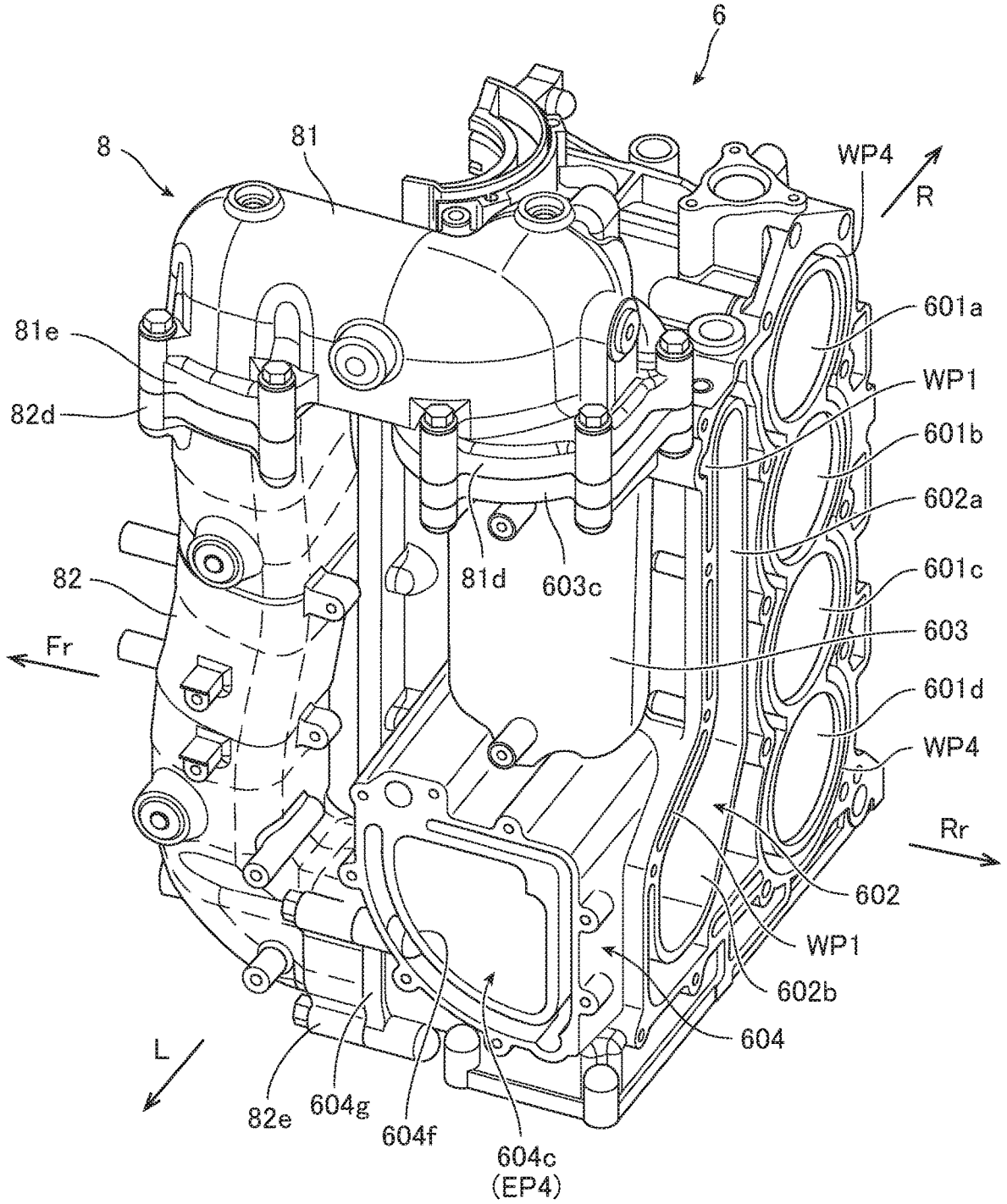
FIG. 3 is a perspective view of a periphery of a cylinder block provided in an engine of the outboard motor according to the present embodiment.
Figure 4:
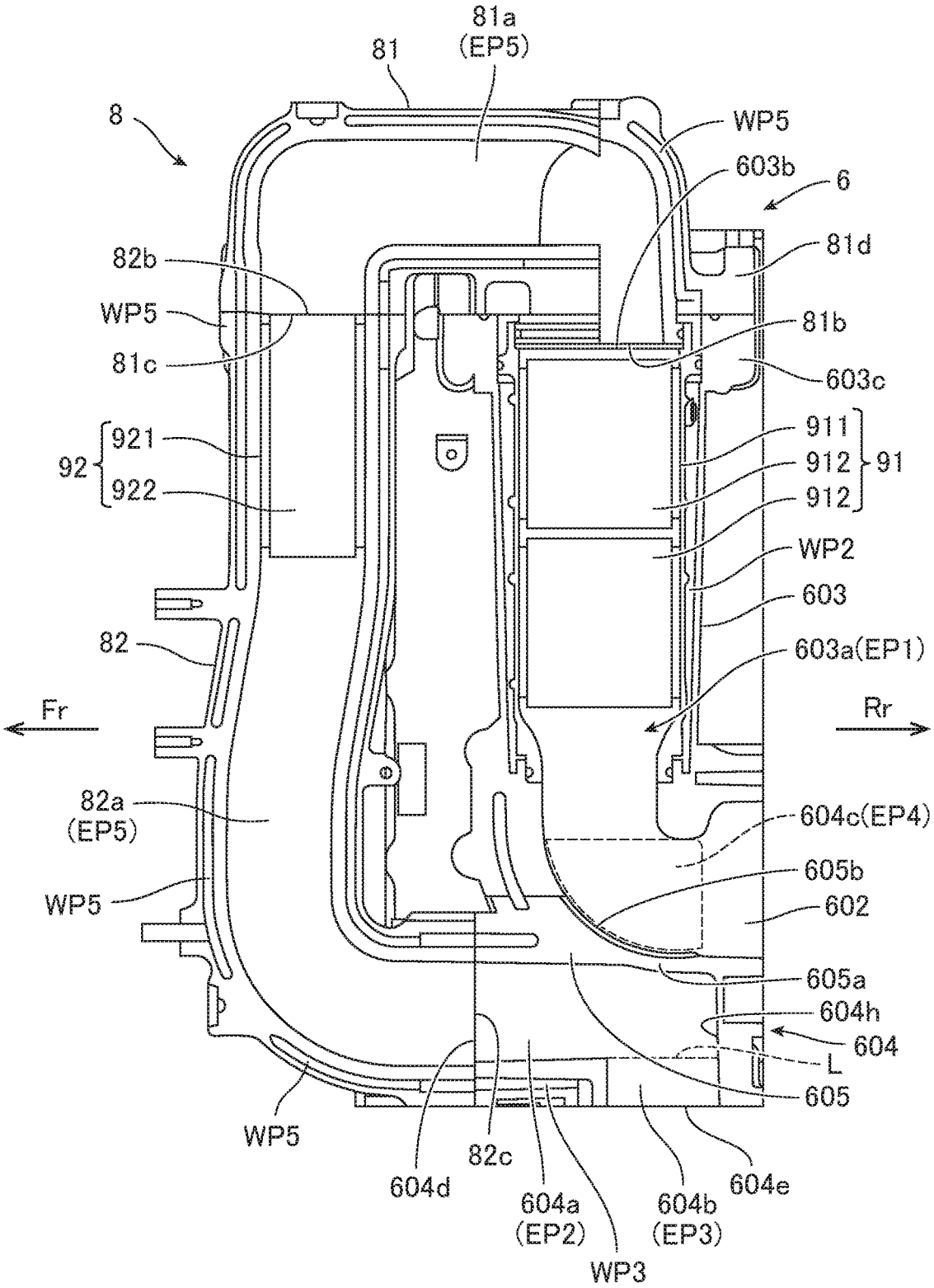
FIG. 4 is a cross-sectional view of an exhaust passage on the periphery of the cylinder block provided in the engine of the outboard motor according to the present embodiment.

FIGS. 3 and 4 are a perspective view and a cross-sectional view, respectively, of the cylinder block 6 including peripheral components provided in the engine 21 of the outboard motor 1 according to the present embodiment. FIGS. 3 and 4 illustrate the form of the cylinder block 6 to be utilized for the catalyst-equipped model. Specifically, a case is illustrated where a bypass member 8 which is separate component from the cylinder block 6 has been coupled to the cylinder block 6. FIG. 4 illustrates a cross section through an exhaust passage formed in the cylinder block 6 (first exhaust passage EP1 to be described later) and an exhaust passage formed in the bypass member 8 (fifth exhaust passage EP5 to be described later).

Figure 5:
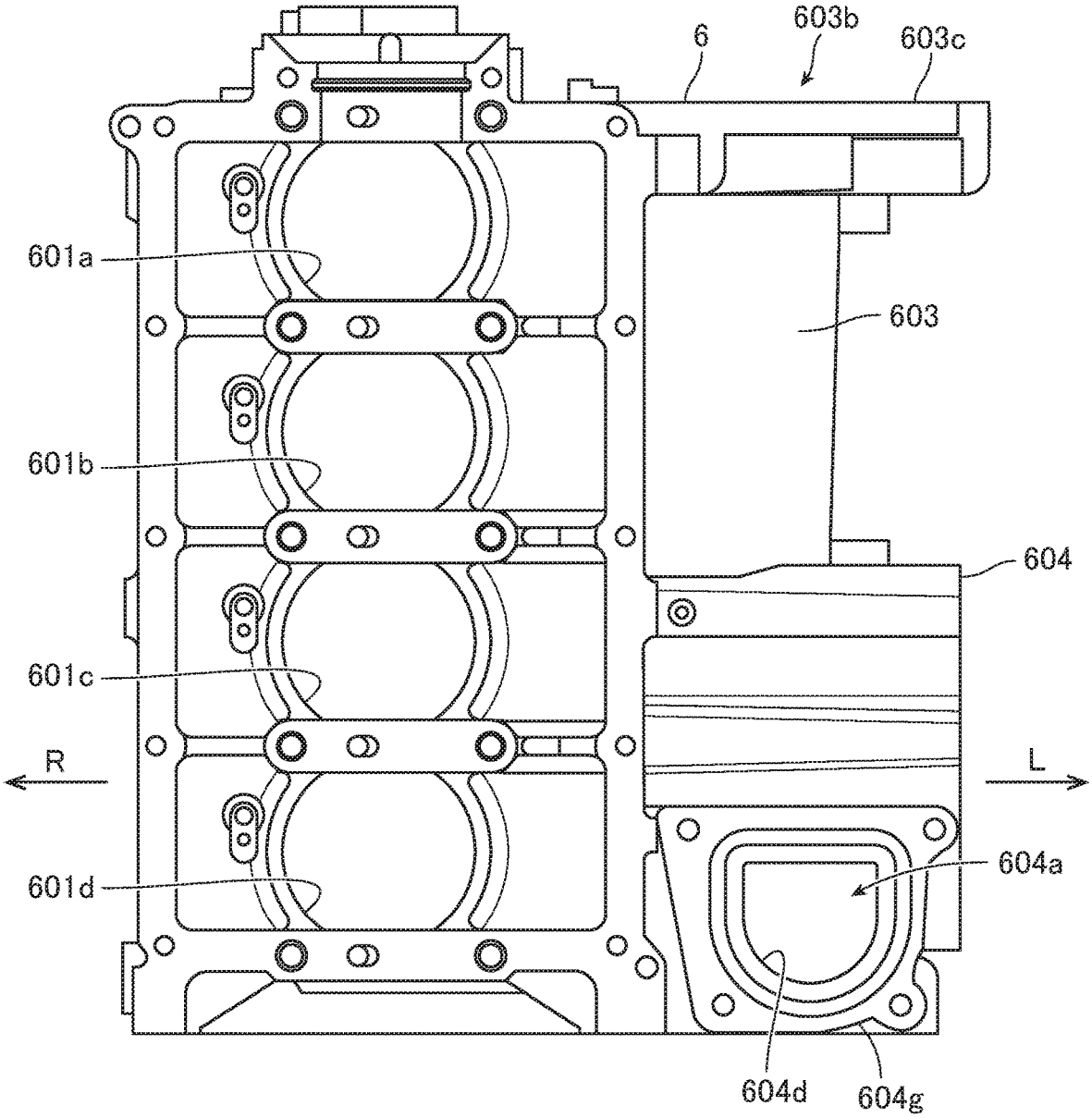
FIG. 5 is a front view of the cylinder block provided in the engine of the outboard motor according to the present embodiment.
Figure 6:
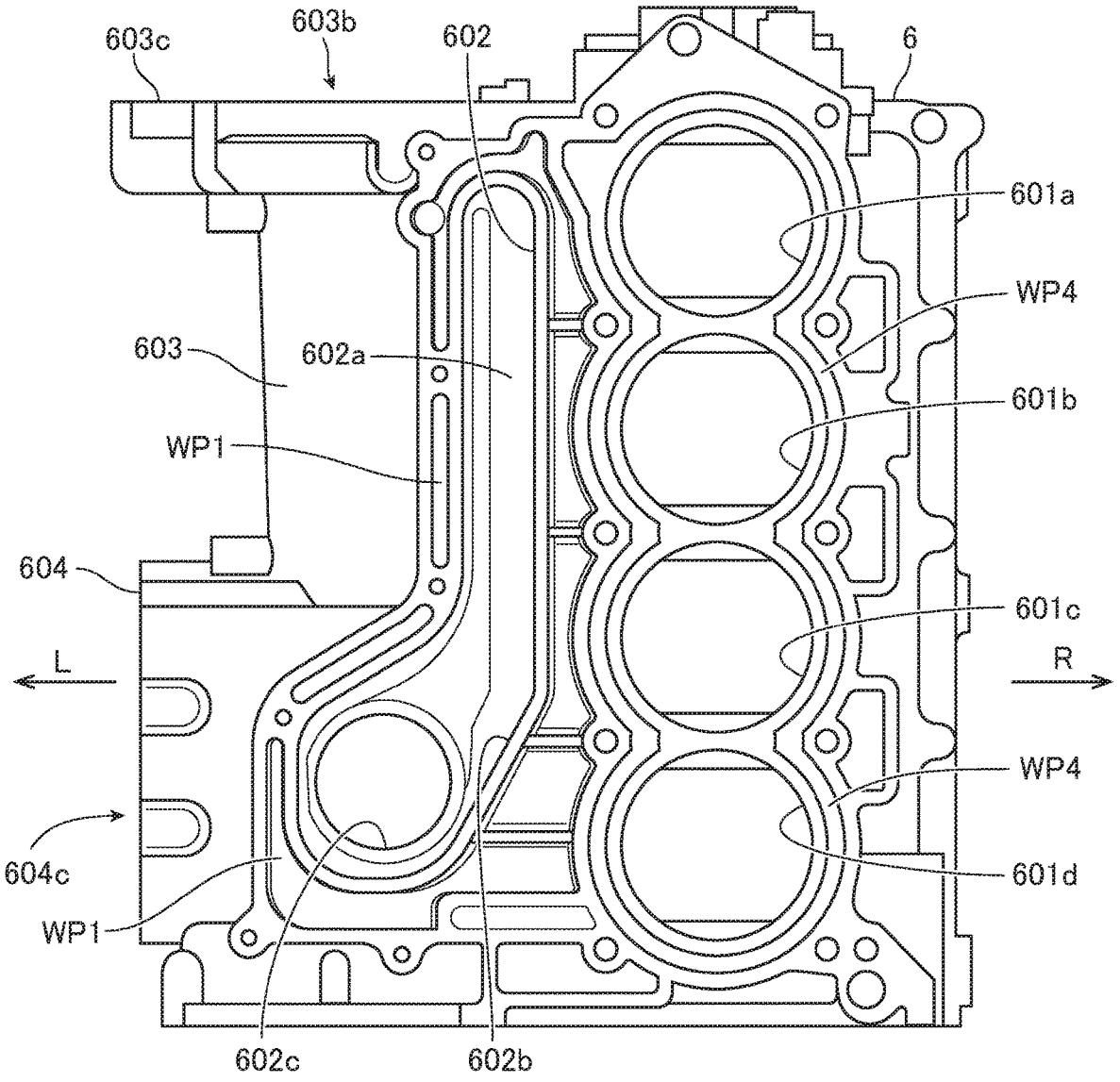
FIG. 6 is a rear view of the cylinder block provided in the engine of the outboard motor according to the present embodiment.
Figure 7:
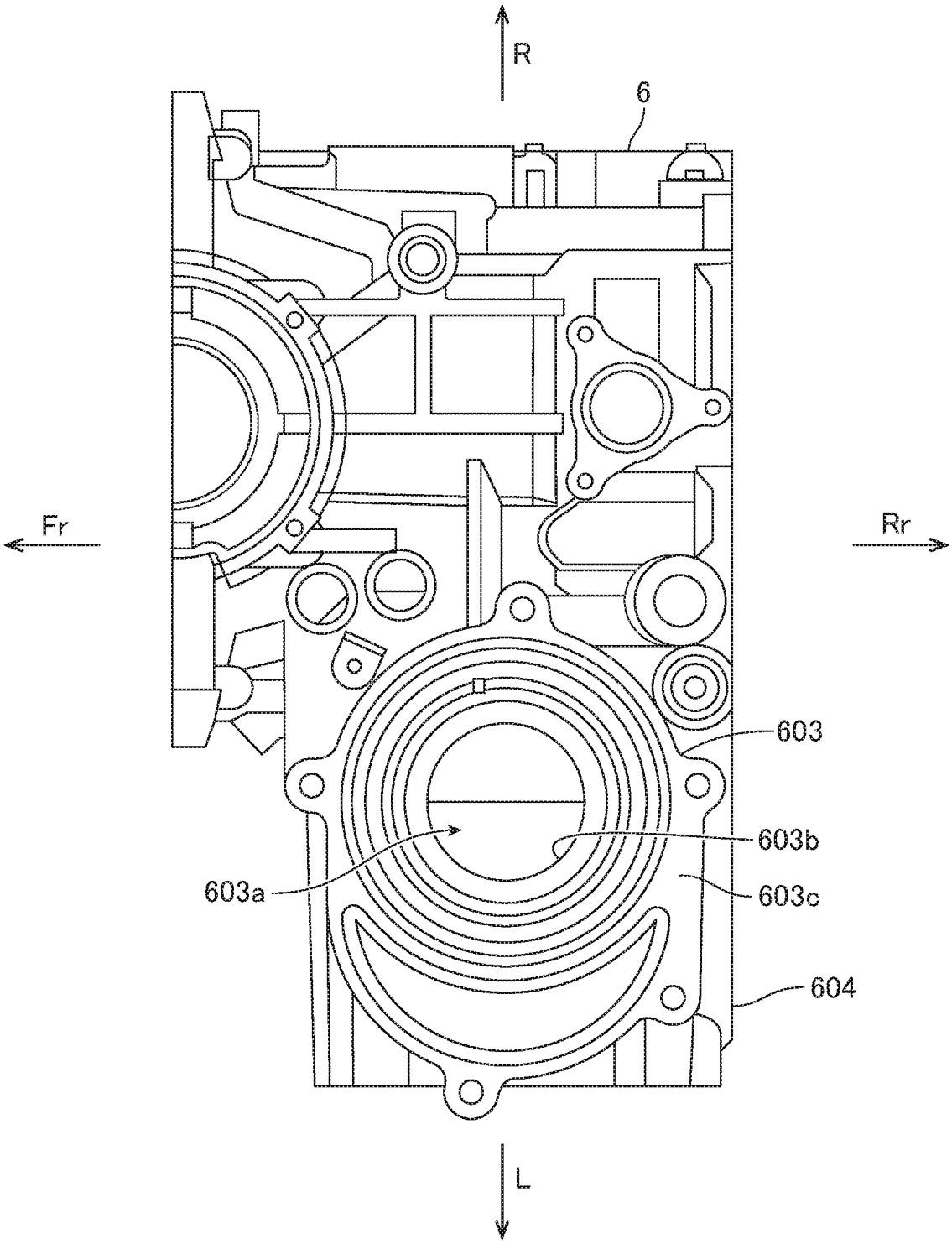
FIG. 7 is a top view of the cylinder block provided in the engine of the outboard motor according to the present embodiment.

FIGS. 5, 6 and 7 are a front view, a rear view, and a top view, respectively, of the cylinder block 6 provided in the engine 21 of the outboard motor 1 according to the present embodiment. FIG. 5 illustrates the mating surface with the crankcase 5 in the cylinder block 6, and FIG. 6 illustrates the mating surface with the cylinder head 7 in the cylinder block 6. In the outboard motor 1 according to the present embodiment, the cylinder block 6 constituting the engine 21 is manufactured by die casting. Hence the cylinder block 6 can be manufactured inexpensively as compared to a case where the cylinder block 6 is manufactured by low-pressure casting. Note that a plurality of spaces formed in the cylinder block 6 (e.g., a space 603*a* and spaces 604*a* to 604*c* to be described later) are formed during die casting using a core (slide core).

As illustrated in FIGS. 3, 5, and 6, cylinders 601*a* to 601*d* are formed vertically side by side on the right side of the cylinder block 6. Each of the cylinders 601*a* to 601*d* is disposed such that its center extends in the front-rear direction and is provided through the cylinder block 6. Each of the cylinders 601*a* to 601*d* houses a piston (not illustrated). The piston is configured to be capable of reciprocation in the front-rear direction in each of the cylinders 601*a* to 601*d* in accordance with explosion of combustion gas in a combustion chamber (not illustrated) formed in a space with the cylinder head 7. In the crankcase 5, the piston is coupled to the crankshaft 23 via a connection rod (con rod), and the reciprocating motion of the piston is converted into a rotational motion of the crankshaft 23.

An exhaust manifold (hereinafter simply referred to as "manifold") 602 is formed to the left sides of the cylinders 601*a* to 601*d* (cf. FIGS. 3 and 6). The manifold 602 is disposed so as to extend in the vertical direction. The upper end of the manifold 602 is disposed at a position slightly above the center of the uppermost cylinder 601*a*. The lower end of the manifold 602 is disposed at a position slightly below than the center of the lowermost cylinder 601*d*.

The manifold 602 is provided by being open on the rear side of the cylinder block 6. That is, the manifold 602 is provided by being opened on the mating surface side of the cylinder head 7. The manifold 602 communicates to the combustion chamber in the cylinder head 7 via an exhaust hole. Exhaust gas generated in the combustion chamber is discharged to the manifold 602.

In a rear view, the manifold 602 includes a linear portion 602*a* extending linearly in the vertical direction, and a bent portion 602*b* that is connected to the lower end of the linear portion 602*a*, is bent diagonally downward to the left, and has a crosswise direction between the inner wall surfaces gradually increasing from the linear portion 602*a* (cf. FIG. 6). As illustrated in FIG. 6, an opening 602*c* is formed at the front end of the bent portion 602*b*. The opening 602*c* is provided communicating to a space 604*c* of a block body 604 to be described later.

In the cylinder block 6, a tubular body 603 extending in the vertical direction (the arrangement direction of the cylinders 601*a* to 601*d*) is formed to the left side of the manifold 602. A space 603*a* is formed inside the tubular body 603 (cf. FIG. 4). An opening 603*b* is formed on the upper surface of the cylinder block 6 (cf. FIG. 7). The space 603*a* in the tubular body 603 is provided communicating to the opening 603*b*. A flange portion 603*c* is formed around the opening 603*b* on the upper surface of the cylinder block 6. The flange portion 603*c* is utilized for joining with a flange portion 81*d* of a first bypass member 81 to be described later.

The block body 604 which generally has a rectangular shape is formed below the tubular body 603. The block body 604 is disposed in a position corresponding to the bent portion 602*b* of the manifold 602 in the rear view (cf. FIG. 6). Three spaces 604*a*, 604*b*, 604*c* are formed inside the block body 604. The spaces 604*a*, 604*b*, 604*c* are formed toward respectively different directions in the block body 604. The spaces 604*a*, 604*b*, 604*c* are provided being open on the front side, the lower side, and the left side of the cylinder block 6, respectively.

As illustrated in FIG. 4, the space 604*a* is provided on the front side of the block body 604, and is formed such that its center extends in the front-rear direction (the longitudinal direction of the cylinders 601*a* to 601*d*). An opening 604*d* is formed on the front surface of the block body 604 (cf. FIG. 5). The space 604*a* is provided communicating to the opening 604*d*. The space 604*a* extends to a rear-side inner wall 604*h* in the block body 604.

As illustrated in FIG. 4, the space 604*b* is provided on the lower side of the block body 604, and is formed such that its center extends in the vertical direction. An opening 604*e* is formed on the lower surface of the block body 604. The space 604*b* is provided communicating to the opening 604*e*. The space 604*b* is provided below the space 604*a*. In FIG. 4, for convenience of description, a dashed line L indicates the boundary portion of the space 604*a* and the space 604*b*. The rear-side portion of the space 604*a* and the upper-side portion of the space 604*b* are provided continuously. Thereby, the space 604*a* and the space 604*b* communicate to each other. In a side view, the space 604*b* is configured to extend to the side opposite to (below) the space 603*a* across the space 604*a* (lower side).

As illustrated in FIG. 3, the space 604*c* is provided on the left side of the block body 604, and is formed such that its center extends in the crosswise direction. An opening 604*f* is formed on the left side surface of the block body 604. The space 604*c* is provided communicating to the opening 604*f*.

The tubular body 603 is disposed above the right-side end of the space 604*c* (cf. FIG. 4). In FIG. 4, for convenience of description, a dashed line indicates a position where the space 604*c* is provided. The space 604*c* is provided continuously with the space 603*a* in the tubular body 603. Further, the manifold 602 is provided rearward of the right-side end of the space 604*c*. The space 604*c* is provided continuously with the space in the manifold 602. Thereby, the space 604*c* communicates with the space 603*a* and the space constituting the manifold 602.

Between the space 604*c* and the space 604*a*, a partition wall 605 is provided to separate these spaces.

The space 604*c* and the space 604*a* are provided adjacent to each other across the partition wall 605. The partition wall 605 has a thin portion 605*a* in its rear-side portion, and has an arc-shaped portion 605*b* continuously to the front side of the thin portion 605*a*. The thin portion 605*a* is provided in a position corresponding to the space 604*b* (i.e., above the space 604*b*). The arc-shaped portion 605*b* serves to induce the exhaust gas having flowed from the manifold 602 side to the space 603*a* side.

As illustrated in FIG. 3, the bypass member 8 is disposed forward of the tubular body 603 and the block body 604. The bypass member 8 is disposed so as to extend in the vertical direction while extending in the front-rear direction of the cylinder block 6. Disposing the bypass member 8 in this manner can prevent an increase in the dimension of the cylinder block 6 (engine 21) in the width direction (crosswise direction). In the present embodiment, the bypass member 8 is manufactured by, for example, die casting or low-pressure casting.

In the side view, the bypass member 8 generally has a U-shape being open on the rear side, or a shape formed by vertically reversing a J-shape. As illustrated in FIG. 4, the bypass member 8 has a first bypass member 81 and a second bypass member 82 that are made up of a pair of tubular bodies. Here, the case will be described where the bypass member 8 is made up of the pair of tubular bodies. However, the configuration of the bypass member 8 is not limited thereto but can be changed as appropriate. For example, the bypass member 8 may be made of a single member.

The first bypass member 81 is disposed such that its center extends in the front-rear direction. The first bypass member 81 generally has an L-shape in a top view (cf. FIG. 2). As illustrated in FIG. 4, the front-side end and the rear-side end of the first bypass member 81 each have a configuration to be slightly bent downward. The second bypass member 82 is generally disposed such that its center extends in the vertical direction. The lower end of the second bypass member 82 has a configuration to be bent rearward.

A space 81*a* is formed inside the first bypass member 81. Openings 81*b*, 81*c* are formed on the lower sides of the front-side end and the rear-side end of the first bypass member 81 (cf. FIG. 4). The space 81*a* is provided communicating to these openings 81*b*, 81*c*. Flange portions 81*d*, 81*e* are provided around the openings 81*b*, 81*c*, respectively (cf. FIG. 3). The first bypass member 81 is coupled to the upper end of the tubular body 603 so as to communicate to the space 603*a* via the opening 81*b*. The first bypass member 81 and the tubular body 603 are joined by fastening the flange portion 81*d* and the flange portion 603*c* with a screw.

A space 82*a* is formed inside the second bypass member 82. An opening 82*b* is formed at the upper-side end of the second bypass member 82. The space 82*a* is provided communicating to the opening 82*b*. The second bypass member 82 is coupled to the lower side of the first bypass member 81 so as to communicate to the space 81*a* via the opening 82*b*. A flange portion 82*d* is provided around the opening 82*b* (cf. FIG. 3). The second bypass member 82 and the first bypass member 81 are joined by fastening the flange portion 82*d* and the flange portion 81*d* with a screw.

Meanwhile, an opening 82*c* is formed at the rear of the lower-side end of the second bypass member 82 (cf. FIG. 4). The space 82*a* is provided communicating to the opening 82*c*. The second bypass member 82 is coupled to the front side of the block body 604 so as to communicate to the space 604*a* via the opening 82*c*. A flange portion 82*e* is provided around the opening 82*c* (cf. FIG. 3). The second bypass member 82 and the block body 604 are joined by fastening the flange portion 82*e* and a flange portion 604*g* of the block body 604 with a screw.

Here, the exhaust passages in the engine 21 according to the present embodiment will be described. When the engine 21 is utilized for the catalyst-equipped model, as illustrated in FIGS. 3 and 4, in the cylinder block 6, the space 603*a* in the tubular body 603 constitutes a first exhaust passage EP1. The first exhaust passage EP1 extends in the arrangement direction of the cylinders 601*a* to 601*d* (vertical direction) and has an opening end made of an opening 603*b*.

Further, in the cylinder block 6, the space 604*a* in the block body 604 constitutes a second exhaust passage EP2, the space 604*b* constitutes a third exhaust passage EP3, and the space 604*c* constitutes a fourth exhaust passage EP4. The second exhaust passage EP2 extends in the longitudinal direction of the cylinders 601*a* to 601*d* (front-rear direction) and has an opening end made of an opening 604*d*. Between the first exhaust passage EP1 and the second exhaust passage EP2, the fourth exhaust passage EP4 is provided extending in the direction orthogonal to both the first exhaust passage EP1 and the second exhaust passage EP2. Further, in the bypass member 8, the space 81*a* in the first bypass member 81 and the space 82*a* in the second bypass member 82 constitute a fifth exhaust passage EP5.

As illustrated in FIG. 4, the fourth exhaust passage EP4 is provided in the coupling portion of the manifold 602 and the first exhaust passage EP1. The fourth exhaust passage EP4 is configured separately from the first exhaust passage EP1 in order to form on the inner wall a curved surface that induces the exhaust gas having flowed from the manifold 602 to the first exhaust passage EP1 side. When such a curved surface is formed by utilizing a core for forming the space 603*a* constituting the first exhaust passage EP1 or the space constituting the manifold 602, a situation may occur in which a smooth curved surface cannot be formed in the corner portion, thus causing a decrease in the exhaust efficiency in the exhaust passage. By utilizing a dedicated core for forming the curved surface as in the present embodiment, it is possible to form a desired curved surface in the corner portion and improve the exhaust efficiency in the exhaust passage.

Around the exhaust passage, a cooling channel is formed to allow the flow of cooling water utilized for cooling the exhaust gas. For example, in the cylinder block 6, a cooling channel WP1 is formed around the manifold 602 (cf. FIG. 3). A cooling channel WP2 is formed around the space 603*a* constituting the first exhaust passage EP1 (cf. FIG. 4). A cooling channel WP3 is formed around the spaces 604*a*, 604*b* constituting the second exhaust passage EP2 and the third exhaust passage EP3. In the cylinder block 6, a cooling channel WP4 is also formed around the cylinders 601*a* to 601*d* (cf. FIG. 3). Meanwhile, in the bypass member 8, a cooling channel WP5 is formed around the spaces 81*a*, 82*a* constituting the fifth exhaust passage EP5.

In the engine 21 according to the present embodiment, a first catalyst unit 91 is housed in the space 603*a* constituting the first exhaust passage EP1, and a second catalyst unit 92 is housed in the space 82*a* constituting the fifth exhaust passage EP5. The first catalyst unit 91 includes a catalyst holder 911 and a catalyst 912 held in the catalyst holder 911. The first catalyst unit 91 includes a pair of catalysts 912. The catalyst holder 911 holds the catalyst 912 so that the catalyst 912 is disposed on the first exhaust passage EP1. Similarly, the second catalyst unit 92 includes a catalyst holder 921 and a catalyst 922 held in the catalyst holder 921. The catalyst holder 921 holds the catalyst 922 so that the catalyst 922 is disposed on the fifth exhaust passage EP5.

Before the attachment of the bypass member 8, the first catalyst unit 91 with respect to the first exhaust passage EP1 is configured so as to be detachable from the upper side of the cylinder block 6. Such a detachable configuration makes it possible to improve work efficiency during maintenance for the catalyst unit housed in the cylinder block 6. Here, the description has been given of the case where the catalyst units are disposed in the first exhaust passage EP1 and the fifth exhaust passage EP5. However, the catalyst unit may be disposed in either one of the exhaust passages depending on the purification performance required.

Here, a description will be given of the flow of the exhaust gas in the case where the engine 21 is utilized for the catalyst-equipped model. In the cylinder block 6, the exhaust gas from the cylinders 601*a* to 601*d* flows into the manifold 602 via the cylinder head 7. Then, the exhaust gas having flowed into the manifold 602 proceeds downward along the linear portion 602*a* and flows into the fourth exhaust passage EP4 via the opening 602*c*. The exhaust gas having flowed into the fourth exhaust passage EP4 turns its flow direction upward along the inner wall surface of the fourth exhaust passage EP4 and proceeds upward along the first exhaust passage EP1. The exhaust gas is purified by the first catalyst unit 91 when flowing upward along the first exhaust passage EP1.

Although omitted in FIG. 3, the opening 604*f* of the space 604*c* constituting the fourth exhaust passage EP4 is closed by a plate P1 (cf. FIG. 1). During the assembly of the engine 21, the plate P1 is fixed to the block body 604 so as to close the opening 604*f* from the left side. Therefore, during the operation of the engine 21, the exhaust gas having flowed from the manifold 602 into the fourth exhaust passage EP4 does not flow out from the opening 604*f*.

The exhaust gas having passed through the first exhaust passage EP1 flows into the fifth exhaust passage EP5 formed in the space 81*a* and proceeds forward. When proceeding to the vicinity of the front end in the space 81*a*, the exhaust gas turns its flow direction downward and proceeds downward along the fifth exhaust passage EP5 formed in the space 82*a*. The exhaust gas is purified by the second catalyst unit 92 when proceeding downward along the fifth exhaust passage EP5 formed in the space 82*a*. The exhaust gas having flown into the vicinity of the lower end of the fifth exhaust passage EP5 turns its flow direction rearward along the inner wall surface of the fifth exhaust passage EP5 and flows into the second exhaust passage EP2. The exhaust gas having flowed into the second exhaust passage EP2 turns its flow direction downward and proceeds downward along the third exhaust passage EP3. Then, the exhaust gas flows into an exhaust passage (not illustrated) formed in an engine base below the cylinder block 6.

Figure 8:
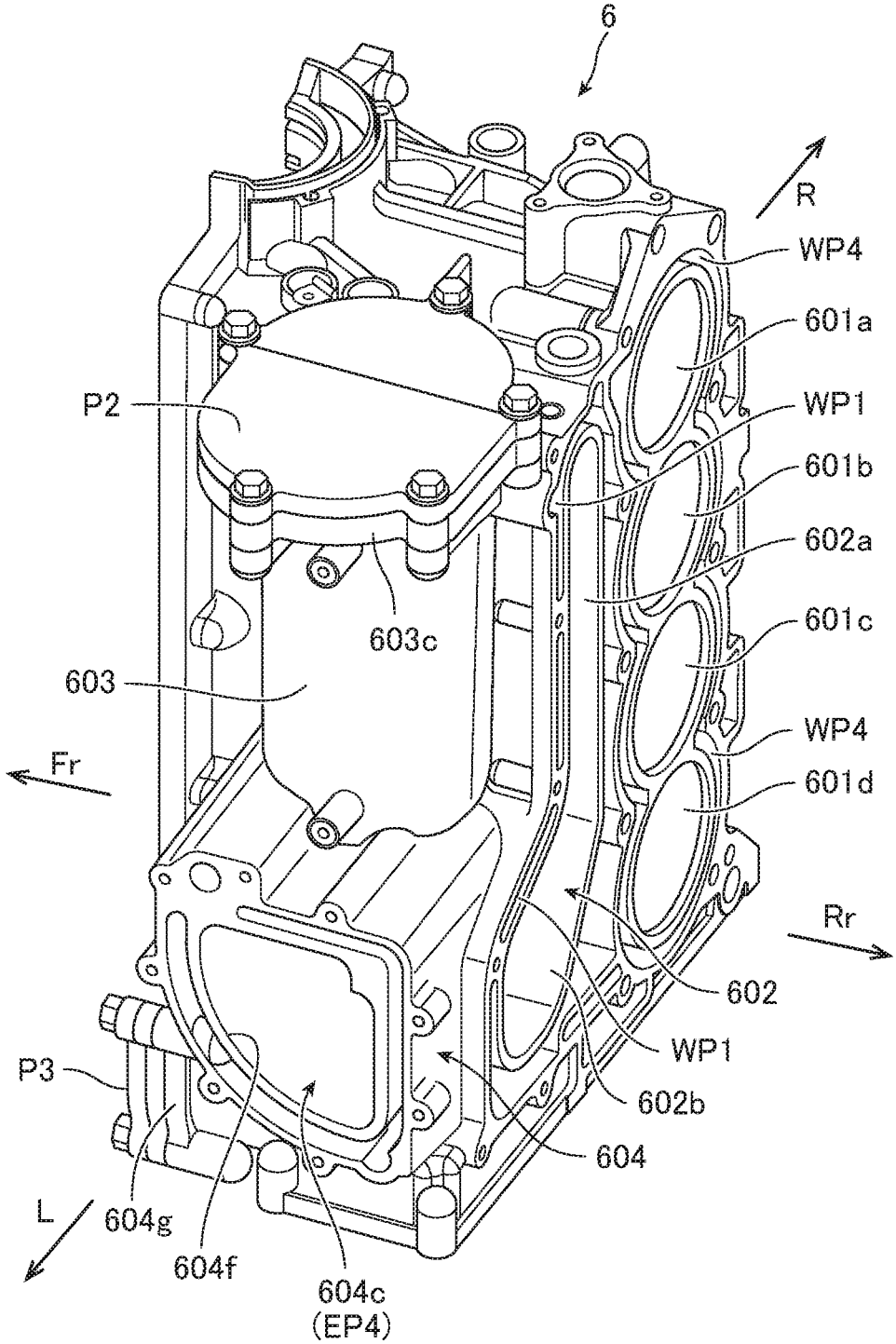
FIG. 8 is a perspective view of the periphery of the cylinder block provided in the engine of the outboard motor according to the present embodiment.
Figure 9:
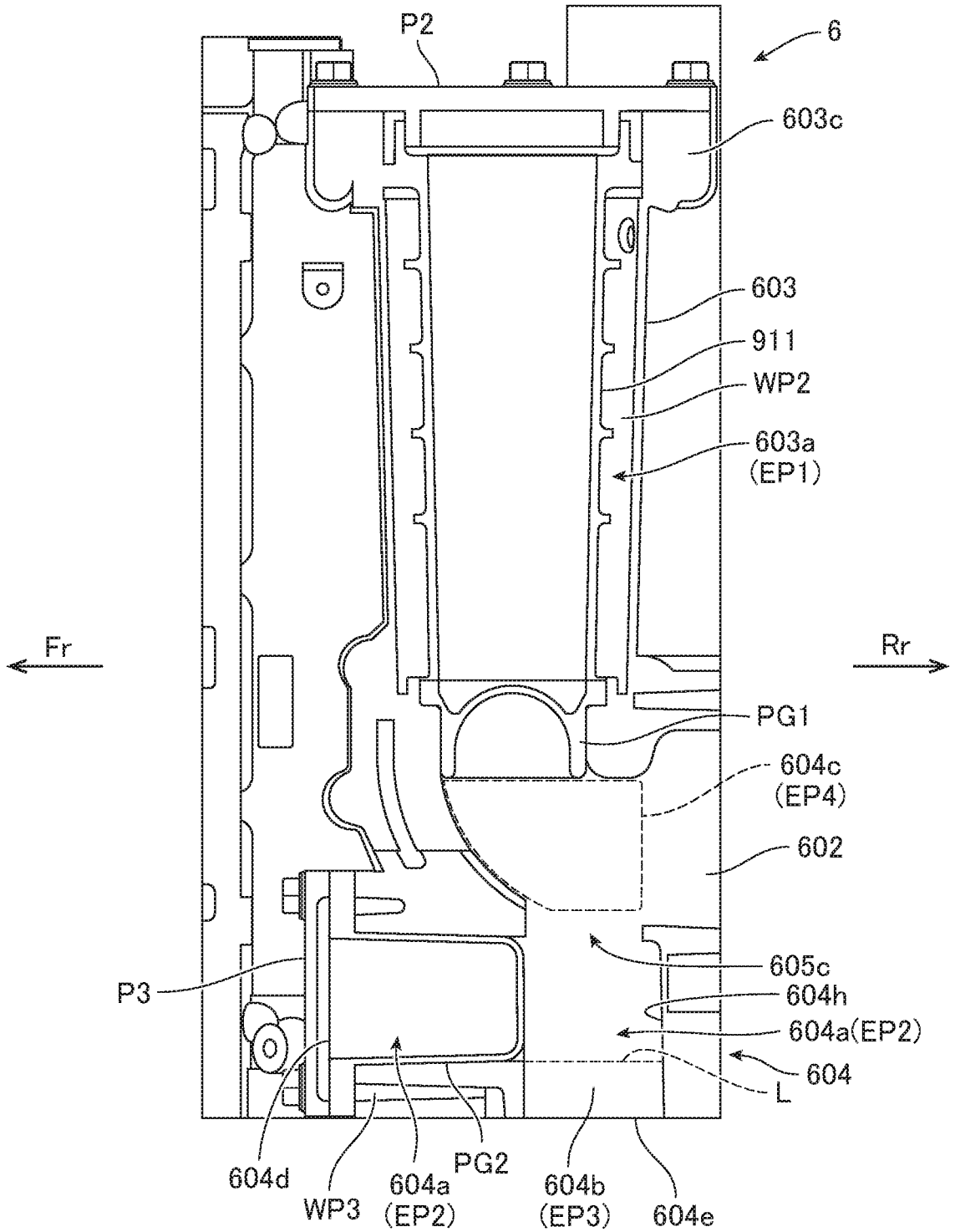
FIG. 9 is a cross-sectional view of the exhaust passage on the periphery of the cylinder block provided in the engine of the outboard motor according to the present embodiment.
Figure 10:
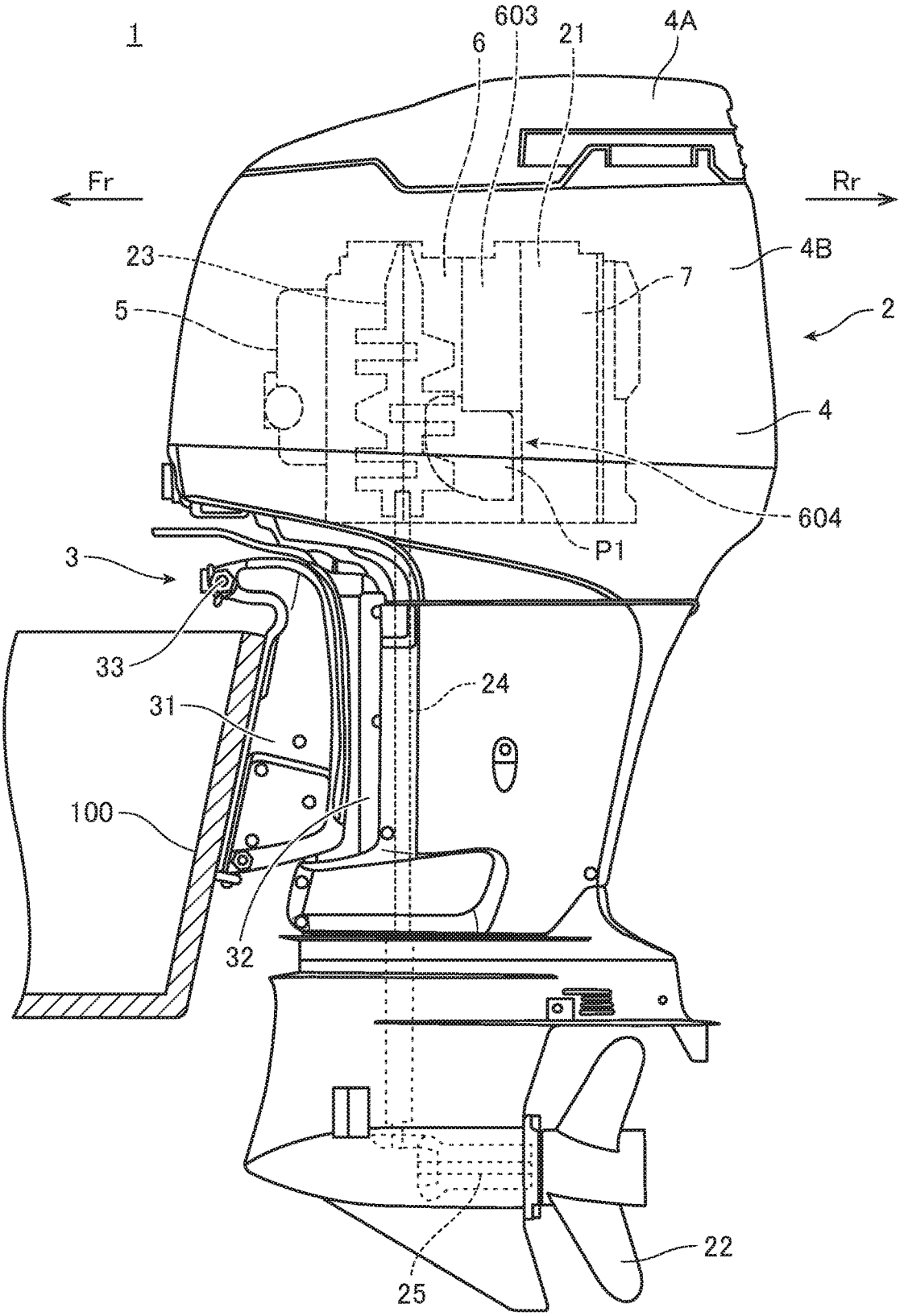
FIG. 10 is a left side view illustrating a schematic configuration of the outboard motor according to the present embodiment.

In the outboard motor 1 according to the present embodiment, the cylinder block 6 as thus described is also utilized in the engine 21 for the non-catalyst-equipped model. Hereinafter, the form of the cylinder block 6 utilized for the non-catalyst-equipped model will be described with reference to FIGS. 8 to 10. FIGS. 8 and 9 are a perspective view and a cross-sectional view, respectively, of the cylinder block 6 provided in the engine 21 of the outboard motor 1 according to the present embodiment. FIG. 9 illustrates a cross-section through the exhaust passage (first exhaust passage EP1) formed in the cylinder block 6. FIG. 10 is a left side view illustrating the schematic configuration of the outboard motor 1 according to the present embodiment.

As illustrated in FIGS. 8 and 9, when the engine 21 is utilized for the non-catalyst-equipped model, the bypass member 8 is not attached to the cylinder block 6. The opening 603*b* of the tubular body 603 and the opening 604*d* of the block body 604, to which the bypass member 8 has attached, are closed by plates P2, P3, respectively. The plate P2 is fixed with a screw from the upper side of the cylinder block 6 to the flange portion 603*c* of the tubular body 603. Similarly, the plate P3 is fixed with a screw from the front side of the cylinder block 6 to the flange portion 604*g* of the block body 604.

The catalyst holder 911 and a plug PG1 are housed in the space 603*a* communicating to the opening 603*b*. The plug PG1 is provided in the space 603*a* while pressed downward via the catalyst holder 911. The lower-side end of the plug PG1 extends to a position facing the space 604*c* that constitutes the fourth exhaust passage EP4. Here, the case of fixing the plug PG1 via the catalyst holder 911 has been described, but this is not restrictive, and the plug PG1 may be changed in shape and directly fixed by the plate P2.

The catalyst holder 911 and the plug PG1 occupy substantially the entire area of the space 603*a* constituting the first exhaust passage EP1. This significantly reduces volumes in the space 604*c* and the space 603*a*. A recess having a hemispherical shape is formed on the lower surface of the plug PG1. The recess serves to induce the exhaust gas, having flowed into the fourth exhaust passage EP4 via the manifold 602, to the third exhaust passage EP3 provided on the lower side.

A plug PG2 is housed in the space 604*a* communicating to the opening 604*d*. The plug PG2 is provided in the space 604*a* while pressed rearward by the plate P3. The rear-side end of the plug PG2 extends to the vicinity of the center of the space 604*a* constituting the second exhaust passage EP2. The plug PG2 occupies a part of the entire front side of the space 604*a* constituting the second exhaust passage EP2. This significantly reduces volumes in the space 604*a* and the space 604*b*.

In the case of the utilization for the non-catalyst-equipped model, in a raw blank of the cylinder block 6, the partition wall 605 between the space 604*a* constituting the second exhaust passage EP2 and the space 604*c* constituting the fourth exhaust passage EP4 (cf. FIG. 4) is removed. For example, the partition wall 605 is removed by machining. In a portion where the partition wall 605 has been removed, a communication hole 605*c* is formed. Through this communication hole 605*c*, the space 604*a* (second exhaust passage EP2) and the space 604*c* (fourth exhaust passage EP4) communicate to each other. The communication hole 605*c* is formed in a position corresponding to the thin portion 605*a* (cf. FIG. 4). By forming the communication hole 605*c* in the position corresponding to the thin portion 605*a*, the communication hole 605*c* can be provided on the extension line of the space 604*b* (third exhaust passage EP3), and the exhaust gas having flowed into the fourth exhaust passage EP4 via the manifold 602 can be allowed to efficiently flow into the third exhaust passage EP3.

In the cylinder block 6 utilized for the non-catalyst-equipped model, the exhaust gas from the cylinders 601*a* to 601*d* flows into the manifold 602 via the cylinder head 7. Then, the exhaust gas having flowed into the manifold 602 proceeds downward along the linear portion 602*a* and flows into the fourth exhaust passage EP4 via the opening 602*c*. As described above, the catalyst holder 911 and plug PG1 occupy the first exhaust passage EP1. Meanwhile, the fourth exhaust passage EP4 and the second exhaust passage EP2 communicate via the communication hole 605*c*. Hence the exhaust gas having flowed into the fourth exhaust passage EP4 turns its flow direction downward and flows into the second exhaust passage EP2. Then, the exhaust gas proceeds downward along the third exhaust passage EP3 via the second exhaust passage EP2 and flows into the exhaust passage (not illustrated) formed below of the cylinder block 6.

As thus described, for the engine 21 of the outboard motor 1 according to the present embodiment, the raw blank of the cylinder block 6 can be used for both of the following two exhaust routes: a route (first exhaust route) in which, when the engine 21 is to be utilized for the catalyst-equipped model, the exhaust gas proceeds from the fourth exhaust passage EP4 to the first exhaust passage EP1, and is allowed to flow along the second exhaust passage EP2 and the third exhaust passage EP3 via the fifth exhaust passage EPS; and a route (second exhaust route) in which, when the engine 21 is to be utilized for the non-catalyst-equipped model, the exhaust gas is allowed to flow from the fourth exhaust passage EP4 to the second exhaust passage EP2 and the third exhaust passage EP3, and one of the first exhaust route and the second exhaust route is selected to be used as the exhaust passage.

Thus, by selectively using the exhaust passages (first to fourth exhaust passages EP1 to EP4) formed in the cylinder block 6, it is possible to achieve the engine 21 for the catalyst-equipped model and the non-catalyst-equipped model without the need for a large-scale change. Further, with the exhaust passages (first to fourth exhaust passages EP1 to EP4) being formed in the cylinder block 6, the manufacturing can be facilitated as compared to the case of forming the exhaust passages in the cylinder head and the exhaust manifold that are generally manufactured by low-pressure casting. Moreover, with the catalyst unit (first catalyst unit 91) being disposed in the exhaust passage (first exhaust passage EP1) in the cylinder block 6, it is possible to reduce the restriction on the upper limit of the size of the catalyst 912 and ensure the exhaust-gas purifying performance as compared to a case where the catalyst unit is disposed in the exhaust manifold.

In the engine 21, in the case of the utilization for the catalyst-equipped model, the opening 603*b* (the opening end of the first exhaust passage EP1) and the opening 604*d* (the opening end of the second exhaust passage EP2) of the cylinder block 6 are coupled by the fifth exhaust passage EP5 in the bypass member 8 to form a part of the first exhaust route, and the catalyst unit (first catalyst unit 91, second catalyst unit 92) is disposed in the exhaust passage of the first exhaust route. Hence it is possible to utilize the engine 21 for the catalyst-equipped model only by attaching the bypass member 8 to the cylinder block 6. Further, since the catalyst unit is disposed in the exhaust passage of the first exhaust route formed by attaching the bypass member 8 to the cylinder block 6, it is possible to make the arrangement of the catalyst unit flexible and ensure the size of the catalyst to be placed in the exhaust passage.

In the engine 21, the fifth exhaust passage EP5 in the bypass member 8 is provided so as to extend in the longitudinal direction of the plurality of cylinders 601*a* to 601*d* (front-rear direction) and the arrangement direction of the plurality of cylinders 601*a* to 601*d* (vertical direction). Disposing the fifth exhaust passage EP5 in this manner can prevent an increase in the dimension of the engine 21 (cylinder block 6) in the width direction (crosswise direction). In particular, in the side view, the fifth exhaust passage EP5 has a U-shape or a J-shape to allow the exhaust gas to flow in the longitudinal direction of the plurality of cylinders (front-rear direction) and the arrangement direction of the plurality of cylinders (vertical direction). Constituting the fifth exhaust passage EP5 in this manner enables the coupling between the opening end (opening 603*b*) of the first exhaust passage EP1 and the opening end (opening 604*d*) of the second exhaust passage EP2 in a simple configuration.

In the engine 21, the third exhaust passage EP3 is communicated with the exhaust passage formed outside (below) the cylinder block 6, and the exhaust gas is discharged from the third exhaust passage EP3 to the outside of the cylinder block 6. In this case, it is possible to discharge the exhaust gas from the third exhaust passage EP3, which is utilized for both of the catalyst-equipped model and the non-catalyst-equipped model, to the outside of the cylinder block 6, so that there is no need to provide exhaust passages separately dedicated to the catalyst-equipped model and the non-catalyst-equipped model. As a result, the exhaust gas can be discharged outside the cylinder block 6 in a simple configuration.

On the other hand, in the engine 21, in the case of the utilization for the non-catalyst-equipped model, the opening ends of the first exhaust passage EP1 and the second exhaust passage EP2 are closed while the communication hole 605*c* is provided in the partition wall 605 formed between the fourth exhaust passage EP4 and the second exhaust passage EP2, to be used as the exhaust passage of the second exhaust route. Therefore, only by performing simple processing (e.g., machining), the exhaust passage of the second exhaust route can be configured utilizing some of the exhaust passages to be utilized for the catalyst-equipped model (from the fourth exhaust passage EP4 to the second exhaust passage EP2 and the third exhaust passage EP3). As a result, it is possible to achieve the non-catalyst-equipped model while reducing the manufacturing cost.

In the engine 21, in the case of the utilization for the non-catalyst-equipped model, the plugs PG1, PG2 are provided in the recesses (space 603*a* and space 604*a*) formed in the cylinder block 6 to reduce the volume. However, the utilization form of the cylinder block 6 in the case of the utilization for the non-catalyst-equipped model is not limited thereto but can be changed as appropriate. For example, the recess in the cylinder block 6 may be left to be utilized as a resonant device (resonator). By utilizing the recess in the cylinder block 6 as the resonance device in this manner, it is possible to reduce noise generated at a particular rotational speed in the engine 21. Note that it is possible to select whether to utilize one or both of the space 603*a* and the space 604*a* constituting the recesses as the resonance device in accordance with the silence performance required.

The present invention is not limited to the above embodiment but can be subjected to various changes and then implemented. In the above embodiment, the sizes and shapes illustrated in the accompanying drawings are not limited thereto but can be changed as appropriate within a scope in which the effect of the present invention is exerted. The other elements can be changed as appropriate and implemented so long as not deviating from the scope of the object of the present invention.

For example, in the above embodiment, the case has been described where the present invention is applied to the outboard motor 1 including the parallel four-cylinder engine. However, an application target of the present invention is not limited thereto but can be changed as appropriate. For example, it is also possible to apply the present invention to multi-cylinder engines other than the parallel four-cylinder engine or to various ship propulsion devices other than the outboard motor 1.

In the above embodiment, the case has been described where the bypass member 8 has the configuration to be disposed forward of the tubular body 603 and the block body 604, extending in the front-rear direction and the vertical direction of the cylinder block 6. However, the configuration of the bypass member 8 is not limited thereto but can be changed as appropriate. For example, the bypass member 8 may be configured to extend in the crosswise direction of the cylinder block 6 in accordance with the entire shape of the engine mounted on the outboard motor 1. In addition, although the case has been described where the bypass member 8 has a U-shape or a J-shape in the side view, any shape may be employed in accordance with the position of the opening end of the first exhaust passage EP1 and the opening end of the second exhaust passage EP2 formed in the cylinder block 6.

As described above, the present invention has the effect of being able to ensure sufficient exhaust-gas purifying performance without the need for a complex manufacturing process and achieve an engine for the catalyst-equipped model and the non-catalyst-equipped model without the need for a large-scale change. In particular, the present invention is useful for a ship propulsion device having the catalyst-equipped model and the non-catalyst-equipped model.

The present application is based on Japanese Patent Application No. 2019-110092 filed on Jun. 13, 2019. All this content is included here.

outboard motor
crankcase
cylinder block
cylinder head
bypass member
engine
first bypass member
81*a* space
81*b* opening
81*c* opening
82 second bypass member
82*a* space
82*b* opening
82*c* opening
91 first catalyst unit
911 catalyst holder
912 catalyst
92 second catalyst unit
921 catalyst holder
922 catalyst
601*a* to 601*d* cylinder
602 manifold
602*c* opening
603 tubular body
603*a* space
603*b* opening
604 block body
604*a* to 604*c* space
604*d* to 604*f* opening
605 partition wall
605*c* communication hole
EP1 first exhaust passage
EP2 second exhaust passage
EP3 third exhaust passage
EP4 fourth exhaust passage
EP5 fifth exhaust passage
P1 to P3 plate
PG1, PG2 plug

What is claimed is:

1. A ship propulsion device comprising:

a manifold formed on sides of a plurality of cylinders in a cylinder block; and an exhaust passage that allows exhaust gas to flow from the manifold toward a lower part of the cylinder block, wherein following exhaust passages are formed in a raw blank of the cylinder block:

a first exhaust passage extending in an arrangement direction of the plurality of cylinders and having an opening end;

a second exhaust passage extending in a longitudinal direction of the plurality of cylinders and having an opening end;

a third exhaust passage connected to the second exhaust passage and extending to a side opposite to the first exhaust passage across the second exhaust passage; and a fourth exhaust passage extending in a direction orthogonal to the first exhaust passage and the second exhaust passage between the first exhaust passage and the second exhaust passage, and connecting the first exhaust passage and the manifold, and the raw blank of the cylinder block can be used for both of two exhaust routes (a) and (b):

(a) a first exhaust route in which a fifth exhaust passage coupling the opening end of the first exhaust passage and the opening end of the second exhaust passage is formed in a separate member from the cylinder block, the exhaust gas is allowed to flow via the fourth exhaust passage, the first exhaust passage, the fifth exhaust passage, the second exhaust passage, and the third exhaust passage, and a catalyst is placed in the exhaust passage; and (b) a second exhaust route in which a communication hole is provided in a partition wall provided between the fourth exhaust passage and the second exhaust passage while the opening ends of the first and second exhaust passages are closed, and the exhaust gas is allowed to flow via the fourth exhaust passage, the second exhaust passage, and the third exhaust passage, and one of the first exhaust route and the second exhaust route is selected to be used as the exhaust passage.

2. The ship propulsion device according to claim 1, wherein the fifth exhaust passage is provided so as to extend in the longitudinal and arrangement directions of the plurality of cylinders.

3. The ship propulsion device according to claim 2, wherein the fifth exhaust passage has a U-shape or a J-shape to allow the exhaust gas to flow in the longitudinal and arrangement directions of the plurality of cylinders.

4. The ship propulsion device according to claim 1, wherein a space of the cylinder block formed when the second exhaust route is selected and the opening ends of the first and second exhaust passages are closed is utilized as a resonator.

5. The ship propulsion device according to claim 1, wherein the third exhaust passage is communicated with an exhaust passage formed outside the cylinder block.

6. The ship propulsion device according to claim 1, wherein the cylinder block is a die-cast cylinder block.

* * * * *